US006149076A

United States Patent [19]

Riney

[11] Patent Number: 6,149,076

[45] Date of Patent: Nov. 21, 2000

[54] DISPENSING APPARATUS HAVING NOZZLE FOR CONTROLLING HEATED LIQUID DISCHARGE WITH UNHEATED PRESSURIZED AIR

[75] Inventor: John M. Riney, Suwanee, Ga.

[73] Assignee: Nordson Corporation, Westlake, Ohio

[21] Appl. No.: 09/129,531

[22] Filed: Aug. 5, 1998

[51] Int. Cl.[7] ..... B05B 1/34

[52] U.S. Cl. ..... 239/135; 239/424.5

[58] Field of Search ..... 239/423, 424.5, 239/424, 135, 397.5

[56] References Cited

U.S. PATENT DOCUMENTS

| | | | |
|---|---|---|---|
| 3,408,007 | 10/1968 | Raichle et al. | 239/135 |
| 4,785,996 | 11/1988 | Ziecker et al. | 239/298 |
| 5,194,115 | 3/1993 | Ramspeck et al. | 156/578 |
| 5,292,068 | 3/1994 | Raterman et al. | 239/11 |
| 5,368,233 | 11/1994 | Brusko | 239/290 |
| 5,418,009 | 5/1995 | Raterman et al. | 427/207.1 |
| 5,431,343 | 7/1995 | Kubiak et al. | 239/105 |
| 5,445,324 | 8/1995 | Berry et al. | 239/99 |
| 5,669,557 | 9/1997 | Barrett et al. | 239/135 |

*Primary Examiner*—Charles R. Eloshway
*Attorney, Agent, or Firm*—Wood, Herron & Evans, L.L.P.

[57] ABSTRACT

A liquid dispensing apparatus for dispensing heated liquid, such as hot melt adhesive, onto a substrate includes a dispenser body with a liquid dispensing nozzle portion which has a liquid discharge passage and outlet communicating with the dispenser body. An air cap is mounted to the dispenser body and has an opening to receive the liquid discharge outlet of the nozzle portion. The air cap has an air discharge passage for directing air onto the heated liquid as it exits the liquid discharge outlet. The air discharge passage is thermally isolated from the liquid discharge passage to allow the use of air which is substantially cooler than the heated liquid.

20 Claims, 2 Drawing Sheets

DISPENSING APPARATUS HAVING NOZZLE FOR CONTROLLING HEATED LIQUID DISCHARGE WITH UNHEATED PRESSURIZED AIR

FIELD OF THE INVENTION

The present invention generally relates to a nozzle assembly for directing liquid onto a substrate and, more specifically, to nozzle assemblies that incorporate pattern air for developing specific liquid discharge patterns.

BACKGROUND OF THE INVENTION

It is known to discharge a bead of hot melt adhesive from a nozzle in a spiral pattern so that, for example, the bead is deposited in a series of overlapping loops. Such nozzles typically incorporate a plurality of air discharge passages surrounding an adhesive discharge passage. The air discharge passages direct so-called pattern air toward the discharged adhesive to cause it to take on a specific configuration or pattern on a substrate. When there is relative perpendicular movement between the adhesive bead and an underlying substrate, for example, a pattern of overlapping adhesive loops may be deposited on the substrate. Various apparatus and methods exist for applying liquids such as hot melt adhesives in overlapping, generally circular swirl patterns or other patterns using pressurized streams of air.

In prior dispensing apparatus, the pattern air was typically channeled from an air source through air discharge passages surrounding the adhesive discharge outlet. The air discharge passages have been disposed adjacent to the adhesive discharge passage and in direct thermal communication therewith. As such, the temperature of the structure forming the air discharge passages has been substantially equal to that of the adhesive discharge passage and the adhesive. Unfortunately, if pattern air at relatively cool temperatures, such as ambient temperature, is circulated through the air discharge passages or other air passageways in the apparatus, the adhesive discharge outlet and other adhesive passageways can be cooled to unsatisfactory levels. Specifically, relatively cool pattern air can carry significant amounts of heat away from the nozzle assembly through heat transfer as it moves through the air discharge passages or other air passageways in thermal communication with the hot melt adhesive discharge orifices and/or other adhesive passageways. This cooling effect can cause the adhesive viscosity to increase and thus adversely affect the deposition of the adhesive onto a substrate in the desired pattern or patterns.

To overcome the cooling effect, pattern air has been heated before its introduction into the nozzle assembly. It was found that to effectively minimize the cooling effect, the pattern air must be heated at least 25° F. to 50° F. higher than the target adhesive temperature at the adhesive discharge outlet, which is typically about 300° F. The heated pattern air effectively resolved the cooling effect created by the ambient temperature pattern air, but produced offsetting disadvantages. For example, heating the pattern air above the adhesive temperature increases the complexity of the adhesive dispensing apparatus and increases the cost and labor involved with set-up and operation of the apparatus.

Adhesive or liquid dispensing apparatus of this general type which does not require heated pattern air would have several advantages over the prior designs. For instance, the time required to set up the adhesive dispensing apparatus would be reduced as the time needed to properly adjust the temperature of the air would be eliminated. Additionally, the cost of operation would be reduced due to the elimination of external heaters for the pattern air. Another advantage of using ambient temperature pattern air is that the air may desirably cool the extruded adhesive bead just prior to its contact with the substrate. Because cooler adhesive would contact the substrate, substrate burn-through caused by hot adhesive may be prevented and a thinner substrate could be used, for example, resulting in reduced material cost.

For at least these reasons, it would be desirable to provide a hot melt adhesive or liquid dispenser capable of using ambient temperature pattern air or pattern air that at least does not have to be heated to a temperature approaching the hot melt adhesive or liquid temperature.

SUMMARY OF THE INVENTION

The present invention overcomes the foregoing and other shortcomings and drawbacks of previous liquid dispensing systems and methods involving the use of pressurized pattern air. While the invention will be described in connection with certain preferred embodiments, it will be understood that the invention is not limited to these embodiments. On the contrary, the invention includes all alternatives, modifications and equivalents as may be included within the spirit and scope of the present invention.

The present invention is generally directed to a liquid dispensing apparatus for dispensing heated liquid, such as hot melt adhesive, on a substrate. The liquid dispensing apparatus includes a dispenser body with a liquid passageway adapted to be connected with a source of the heated liquid. A nozzle, which is connected to the dispenser body, has a liquid discharge passage communicating with the liquid passageway of the dispenser body. The nozzle also has at least one air discharge passage, and preferably a plurality thereof, positioned to direct pressurized air at the heated liquid as it exits the liquid discharge passage. Many nozzle configurations have from six to twelve air discharge passages. The air discharge passages are thermally isolated from the liquid discharge passage such that, for example, ambient air traveling through the air discharge passages does not substantially cool the liquid discharge passage and the liquid contained therein. This may be accomplished by incorporating a thermal insulator between the air discharge passages and the liquid discharge passage. In the presently preferred embodiments, this insulator is a space filled with an insulator located between the liquid and air discharge passages. The insulator may be air or some other thermally insulating material.

In the preferred embodiments, the nozzle is made up of two separate pieces, i.e., a liquid dispensing nozzle portion and an air cap. The liquid dispensing nozzle portion is mounted to the dispenser body and has a liquid discharge passage with a liquid discharge outlet which communicate with the liquid passageway in the dispenser body. In a first embodiment, the air cap may be mounted to the dispenser body so as to also secure the liquid dispensing nozzle portion to the dispenser body. In another embodiment, the nozzle portion and air cap may have mating threaded portions to ensure proper alignment of the air discharge passages with respect to the dispensed liquid. The air cap has an opening that receives at least the end of the nozzle portion with the liquid discharge outlet and has a plurality of air discharge passages thermally isolated from the liquid discharge passage. The air discharge passages are positioned to direct pressurized air at the heated liquid as it exits the liquid discharge outlet.

Methods of dispensing heated liquids using pattern air which is at a substantially cooler temperature than the liquid are also contemplated by the invention. The methods can involve dispensing heated liquids with apparatus constructed in accordance with the invention as generally described above. That is, the methods can include dispensing a heated liquid from a dispenser nozzle having a liquid discharge passage connected with a liquid discharge outlet each positioned adjacent to but thermally isolated from at least one air discharge passage. The methods can generally comprise the steps of discharging the liquid at a first temperature from the liquid discharge passage through the liquid discharge outlet and impacting the heated liquid exiting the liquid discharge outlet with at least one air stream directed through the air discharge passage at a second temperature which is substantially lower than the first temperature. The air in the air discharge passage should not cool the heated liquid in the liquid discharge passage by more than about ten percent. The second temperature may be substantially equal to ambient temperature or at least about 50% lower than the first temperature without adversely cooling the liquid in the nozzle.

Accordingly, the present invention provides a liquid dispensing apparatus for depositing heated liquid on a substrate with a pattern generated by relatively cool air impacting the discharged liquid. Air discharge passages associated with the dispensing nozzle are thermally isolated or, in other words, insulated from the liquid discharge passage. Because of the thermal isolation, conventional heated pattern air may be replaced by ambient air or substantially cooler air to achieve advantages such as described above. For example, this can reduce the cost of labor and equipment in the set-up and operation of the liquid dispensing apparatus. Additionally, because the ambient temperature pattern air will partly cool the heated liquid just prior to contacting the substrate, substrate burn-through caused by hot liquid can be prevented and a thinner substrate may be used, resulting in reduced material cost.

Various additional advantages and objects of the invention will become more readily apparent to those of ordinary skill in the art upon consideration of the following detailed description of the presently preferred embodiments taken in conjunction with the accompanying drawings.

DETAILED DESCRIPTION OF THE PREFERRED EMBODIMENTS

Figure 1:
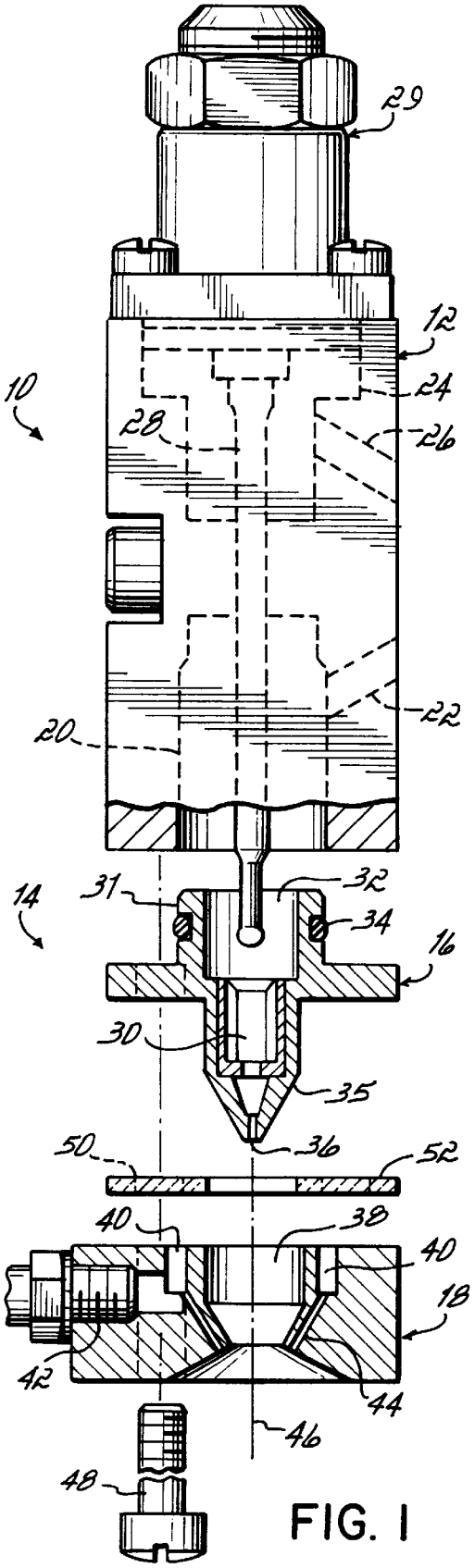
FIG. 1 is an elevational view, in partial cross section, of a liquid dispensing apparatus using thermally isolated pattern air according to one embodiment of the invention.

Referring first to FIG. 1, a liquid dispensing apparatus 10 is shown specifically adapted for dispensing a heated liquid onto a substrate in accordance with the principles of this invention. While it will be understood that any desired heated liquid may be dispensed in accordance with the invention, for the sake of simplicity, the present invention will be described more specifically in connection with dispensing so-called hot melt adhesives. These adhesives are typically dispensed at about 250° F. and above. The inventive principles will be described with reference to only two of many possible embodiments of dispensing apparatus and nozzle configurations falling within the scope of this invention.

As shown in FIG. 1, liquid dispensing apparatus 10 includes a dispenser body 12 connected with a nozzle 14. Although a brief description of apparatus 10 and, specifically, of the interaction between body 12 and nozzle 14 will be given, it will be understood that many types of apparatus and dispensing bodies, including dispensing manifolds, modules or guns, may benefit from the present invention. The invention is therefore not limited to the specific type of dispenser shown in the drawings. In the embodiment shown in FIG. 1, for example, nozzle 14 comprises a liquid dispensing nozzle portion 16 and an air cap 18 which will be described in more detail below. It will be appreciated that liquid dispensing nozzle portion 16 and air cap 18 could be constructed as one operative piece to function as nozzle 14, instead of the two separate pieces as shown.

Dispenser body 12 includes a liquid passageway 20 which is in fluid communication with adhesive port 22. Adhesive port 22 is adapted to connect to a source of hot melt adhesive. Dispenser body 12 also includes an air chamber 24 in fluid communication with actuation air port 26. Actuation air port 26 is adapted to connect to a source of pressurized air (not shown). Dispenser body 12 further includes a valve member and piston assembly 28 which is moved to an open position by the actuation air coming from actuation port 26 and filling air chamber 24. The valve member 28 provides a means to meter the viscous liquid flowing through the liquid dispensing apparatus 10. A conventional spring return mechanism 29 may be provided to close valve member 28 when air pressure through port 26 is turned off. These components of such dispensers are generally known in various forms and, therefore, further detailed discussion is not necessary for an understanding of the invention.

Figure 2:
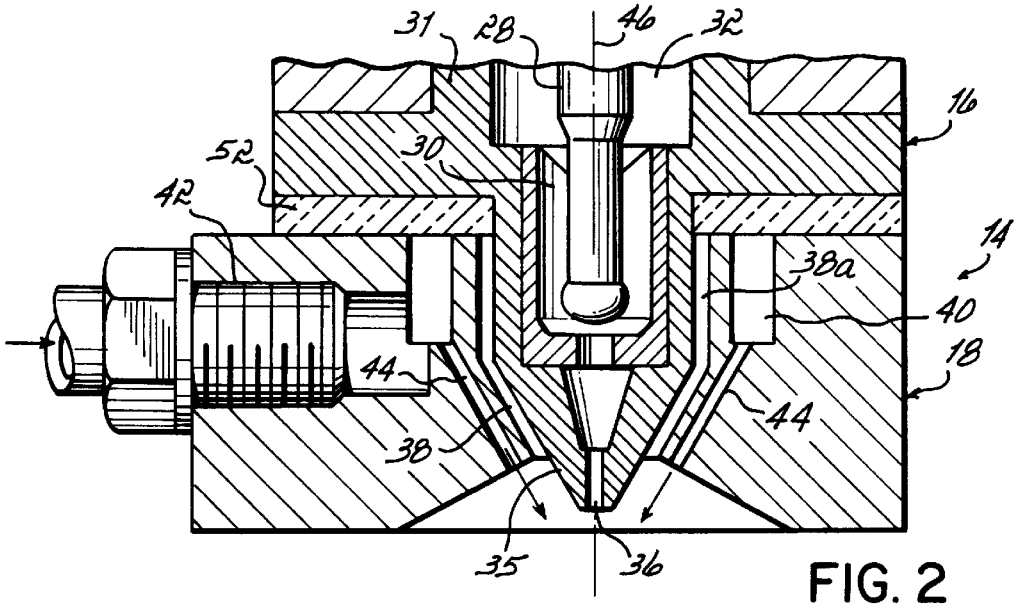
FIG. 2 is an enlarged cross-sectional view of the lower portion of the liquid dispensing apparatus of FIG. 1.

With reference to FIGS. 1 and 2, liquid dispensing nozzle portion 16 includes a adhesive discharge passage 30 which communicates with liquid passageway 20 of dispenser body 12. Liquid dispensing nozzle portion 16 has an inlet end 31 which includes a liquid receiving inlet 32. Inlet end 31 further includes an O-ring 34 externally positioned on the inlet end 31 for sealing against leakage between the inlet end 31 and the adhesive discharge passage 30. Nozzle portion 16 further includes a discharge end 35 which has a liquid discharge outlet 36 communicating with adhesive discharge passage 30 for extruding the liquid hot melt adhesive onto a substrate (not shown).

Figure 3:
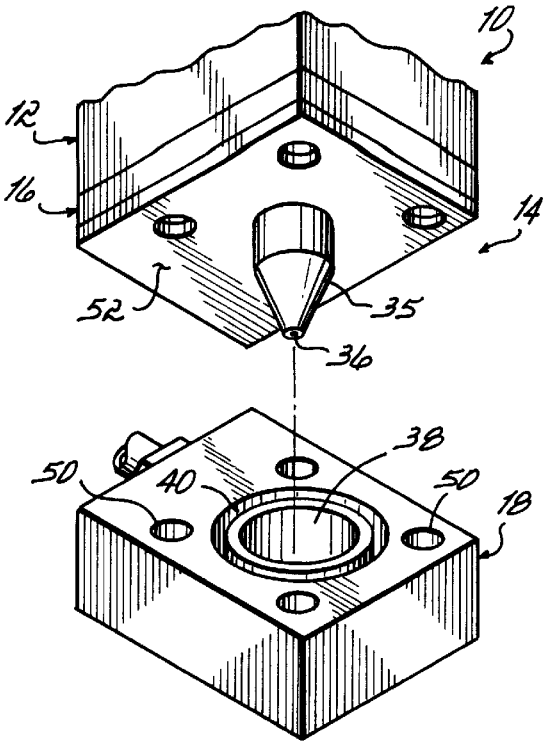
FIG. 3 is a disassembled perspective view of the liquid dispensing nozzle portion and air cap of FIGS. 1 and 2.

With further reference to FIGS. 1 and 2, air cap 18 includes an opening 38 that is adapted to receive at least the end of the liquid dispensing nozzle portion 16 having the liquid discharge outlet 36 (FIGS. 1–3). As will be appreciated from the assembled view of FIG. 2, opening 38 forms an insulating air space disposed between air channel 40 and liquid passage 30 and also between air discharge passages 44 and liquid discharge passage 30. This air space therefore serves as a thermal insulator, although other types of insulative materials may be used as well. Air cap 18 further includes an annular air channel 40 which is in fluid communication with air inlet port 42 which is adapted to connect to a source of pressurized air. Air cap 18 also has a plurality of air discharge passages or, more specifically, orifices 44 which are in fluid communication with air channel 40. Each air discharge passage 44 may be at a compound angle, for example, relative to a liquid extrusion axis 46. In the embodiment shown in FIG. 1, six air discharge passages 44 are equally spaced about the opening 38. With the air discharge passages 44 at compound angles to the liquid extrusion axis 46, the discharged pressurized air from the passages 44 imparts a rotational movement into the liquid being extruded from liquid discharge outlet 36. It can be appreciated that the number of air discharge passages and their compound angles could be selected such that, upon discharge of the liquid hot melt adhesive from liquid discharge outlet 36, a rotational motion is imparted into the liquid. If the liquid dispensing apparatus 10 moves relative to a substrate during its operation, a series of overlapping adhesive loops will be formed on the substrate.

Advantageously, and in accordance with the principles of the present invention, air discharge passages 44 are thermally isolated from the liquid dispensing nozzle portion 16 and its adhesive discharge passage 30. That is, for example, ambient temperature air entering through air inlet port 42 and traveling through air channel 40 and out of the air discharge passages 44 has little or no deleterious thermal influence on the liquid hot melt adhesive traversing through liquid dispensing nozzle portion 16 or its adhesive discharge passage 30. Consequently, and in accordance with the principles of the present invention, even though the air flowing through the air cap 18 may be of ambient temperature or substantially cooler temperature than the liquid in passage 30, that air will not adversely reduce the temperature of the liquid prior to its discharge from outlet 36. Generally, the liquid in adhesive discharge passage 30 and upstream of outlet 36 should not be cooled by ambient pattern air by more than about 10% during continuous or intermittent operation. More preferably, the cooling should be less than about 5%. As one example, hot melt adhesive heated to 300° F. before entering the dispensing apparatus 10 should exit the liquid discharge outlet 36 no cooler than about 275° F. The present invention achieves this objective while enabling the use of pattern air which is introduced in port 42 at less than 50% of the hot melt adhesive temperature, e.g., at less than about 100° F.

Air cap 18 connects to dispenser body 12 holding liquid dispensing nozzle portion 16 therebetween by means of screws 48 inserted through screw holes 50. In the embodiment shown in FIGS. 1–3, a gasket 52 is inserted between liquid dispensing nozzle portion 16 and air cap 18. Gasket 52 can be any material suitable for thermally isolated one component from another, such as Teflon® or Rulon®.

Figure 5:
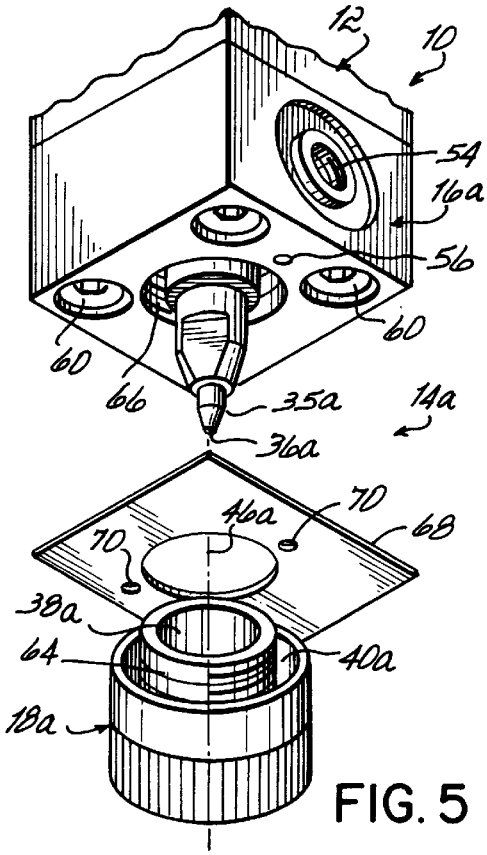
FIG. 5 is a disassembled perspective view of the liquid dispensing nozzle portion and air cap of FIG. 4.
Figure 4:
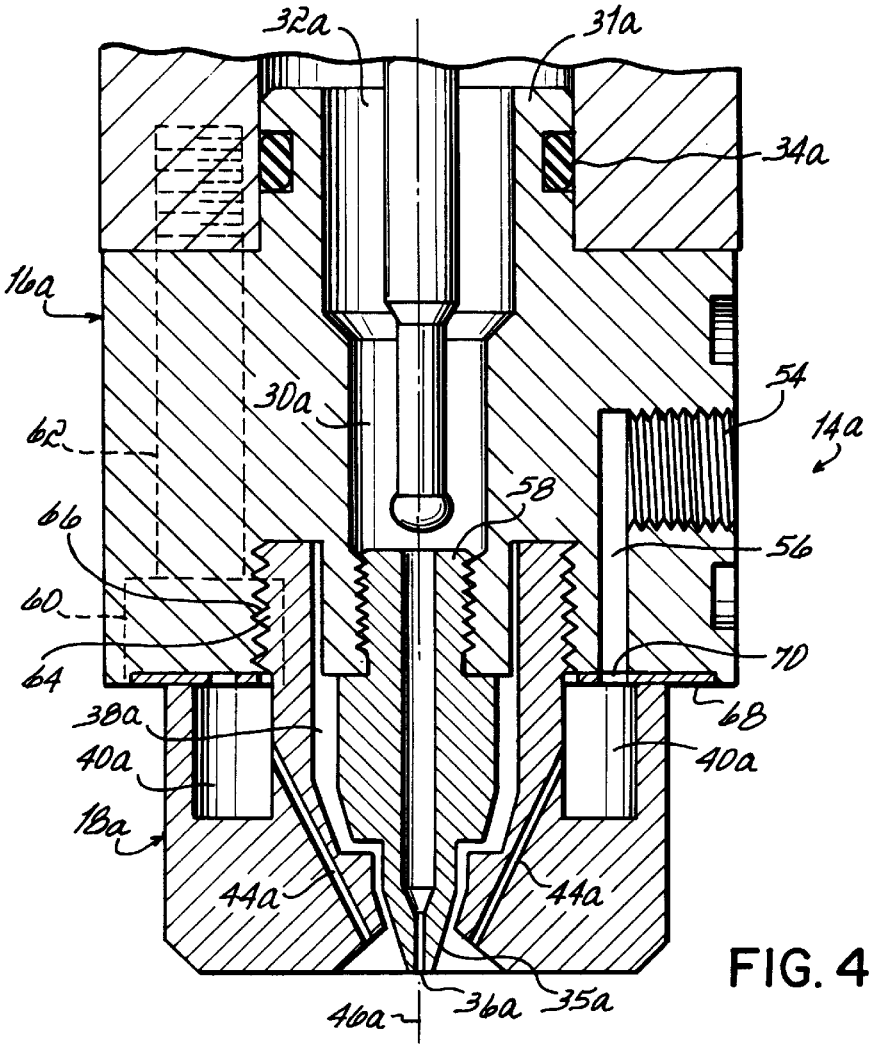
FIG. 4 is an enlarged cross-sectional view of the lower portion of a liquid dispensing apparatus constructed according to another embodiment of the present invention.

With reference to FIGS. 4 and 5, another embodiment is illustrated in accordance with the principles of the present invention. Although the structure is somewhat different than the first embodiment, the principles basic objectives are the same. In this embodiment, a nozzle 14*a* comprises a liquid dispensing nozzle portion 16*a* and an air cap 18*a*. Liquid dispensing nozzle portion 16*a* connects to dispenser body 12. The representative dispenser body 12 is common to both embodiments and details of its structure are basically described above.

Liquid dispensing nozzle portion 16*a* includes an adhesive discharge passage 30*a* which communicates with liquid passageway 20 of dispenser body 12. Liquid dispensing nozzle portion 16*a* has an inlet end 31*a* which includes a liquid receiving inlet 32*a*. Inlet end 31*a* further includes an O-ring 34*a* externally positioned on the inlet end for sealing against liquid between the inlet end and the adhesive discharge passage 30*a*. Nozzle portion 16*a* further includes a discharge end 35*a* which has a liquid discharge outlet 36*a* communicating with adhesive discharge passage 30*a* for extruding the liquid hot melt adhesive onto a substrate (not shown). Liquid dispensing nozzle portion 16*a* further includes an air inlet port 54 communicating with air passageway 56. Air inlet port 54 is adapted to connect to a source of pressurized air. With respect to air inlet ports 42 and 54 of the respective first and second embodiments, it will be appreciated that these ports may be oriented according to the needs of the application. For example, an orientation to the rear of dispenser 12 can allow communication with an unheated or heated air manifold. Other orientations can allow connection with independent air supply lines.

Discharge end 35 is connected to liquid dispensing nozzle portion 16*a* via a threaded portion 58. As such, replacement liquid discharge outlets can be easily installed into or removed from the liquid dispensing nozzle portion 16*a*. Liquid dispensing nozzle portion 16*a* is secured to dispenser body 12 by means of screws 60 insert into screw holes 62. When connected to dispenser body 12, adhesive discharge passage 30*a* is in fluid communication with liquid passageway 20 of the dispenser body.

Again with reference to FIGS. 4 and 5, air cap 18*a* includes an opening 38*a* that is adapted to receive at least the end of the liquid dispensing nozzle portion 16*a* having the liquid discharge outlet 36*a* (FIG. 5). This opening 38*a* forms an insulating air space as discussed above with respect to the first embodiment. Air cap 18*a* further includes an annular air channel 40*a* which is in fluid communication with air passageway 56. Air channels 40 and 40*a* of the first and second embodiments act as distribution channels as well as air diffusers to help provide a uniform flow of air through air discharge passages 44 and 44*a*. Passageway 56 is adapted to connect to a source of pressurized air. Air cap 18*a* also has a plurality of air discharge passages or, more specifically, orifices 44*a* which are in fluid communication with air channel 40*a*. Each air discharge passage 44*a* is at a compound angle relative to the liquid extrusion axis 46*a*. In the embodiment shown in FIG. 4, six air discharge passages 44*a* are equally spaced about the opening 38*a*. As described in the first embodiment above, air exiting air discharge passages 44*a* being at compound angles imparts a rotational movement into the liquid being extruded from liquid discharge outlet 36*a* to produce a series of overlapping loops of hot melt adhesive on a substrate moving relative to the liquid dispensing apparatus 10.

Air cap 18*a* is secured to liquid dispensing nozzle portion 16*a* via threaded portion 64 which screws into internal threads 66 of the nozzle portion. As such, the air cap 18*a* is aligned concentrically with the liquid discharge outlet 36*a* and liquid extrusion axis 46*a*. Advantageously, the air cap 18*a* can be repeatedly attached to the liquid dispensing nozzle portion 16*a* such that it is concentrically aligned each time with the liquid discharge or extrusion axis 46*a*. The concentrically aligned air cap 18*a* helps achieve precise and consistent rotational motion of the liquid hot melt adhesive such that the liquid can be accurately deposited onto a substrate. Advantageously, a washer 68 is positioned between air cap 18*a* and liquid dispensing nozzle portion 16*a*. Washer 68 establishes a substantially air-tight seal between it and the air channel 40*a* of air cap 18*a*. Washer 68 has one or more throughholes 70 which permit fluid communication between air passageway 56 and annular air chamber 40*a*. Without the washer 68 or another suitable gasket or seal, air entering air channel 40*a* via air passageway 56 could escape through the screw holes 62 because the outside wall of the air channel extends over the screw holes.

Similar to the first described embodiment and in accordance with the principles of the present invention, air discharge passages 44*a* are thermally isolated from the liquid dispensing nozzle portion 16*a* and its adhesive discharge passage 30*a*. That is, the ambient temperature air entering through air inlet port 54 and traveling through air channel 40*a* and out of the air discharge passages 44*a* has little or no deleterious thermal influence on the heated liquid traversing through liquid dispensing nozzle portion 16*a* or its adhesive discharge passage 30*a*. Consequently, and in accordance with the principles of the present invention, even though the air flowing through the air cap 18*a* may be of ambient temperature, that air will not reduce the temperature of liquid at the liquid discharge outlet 36*a* by more than 10% of the temperature of the liquid coming from the liquid source. More preferably, the ambient pattern air will not reduce the temperature of liquid at outlet 36*a* by more an 5%. For example, adhesive heated to 300° F. before entering the dispensing apparatus 10 will exit the liquid discharge outlet 36*a* no cooler than 275° F., i.e., cooled less than about 10%. After the liquid has left outlet 36 or 36*a*, it may be advantageously cooled by the ambient pattern air as described above.

In operation, liquid dispensing apparatus 10 deposits a bead of heated, viscous liquid, and more specifically an adhesive, in a series of overlapping loops onto a substrate moving relative to the dispensing apparatus. With reference to the operation of the embodiment shown in FIG. 1, heated adhesive enters adhesive port 22 of dispenser body 12 from an external source. The adhesive is pushed under pressure through liquid passageway 20 and to adhesive discharge passage 30 of liquid dispensing nozzle portion 16. The adhesive is then discharged from liquid discharge outlet 36. Simultaneously, pressurized air enters air inlet port 42, flows through air channel 40 and is discharged through air discharge outlets 44. The discharged air impacts the heated adhesive, as it exits the liquid discharge outlet 36. As previously stated, the compound angles of air discharge outlets 44 impart a rotational motion into the adhesive discharged from liquid dispensing outlet 36. As such, if the target substrate moves in a line perpendicular to the liquid extrusion axis 46 of the liquid dispensing apparatus 10, the adhesive will form a series of overlapping loops of adhesive on the surface of the substrate. At the same time, the adhesive will be cooled by the pattern air as it leaves outlet 36. It will be appreciated that the embodiment of FIGS. 4 and 5 will operate in an analogous manner.

While the present invention has been illustrated by a description of various preferred embodiments and while these embodiments have been described in considerable detail in order to describe the best mode of practicing the invention, it is not the intention of Applicants to restrict or in any way limit the scope of the appended claims to such detail. Additional advantages and modifications within the spirit and scope of the invention will readily appear to those skilled in the art. The invention itself should only be defined by the appended claims, wherein we claim:

1. Apparatus for dispensing heated liquid onto a substrate, comprising:

a dispenser body having a liquid passageway adapted to connect to a source of heated liquid;

a nozzle connected to said dispenser body and having a liquid discharge passage communicating with said liquid passageway, and an air discharge passage adapted to connect to a source of unheated pressurized air, said air discharge passage being positioned relative to said liquid discharge passage to direct pressurized air toward the heated liquid exiting said liquid discharge passage; and a thermal insulation gap containing a thermal insulation medium positioned between said air discharge passage and said liquid discharge passage and coextensive with at least said air discharge passage for substantially preventing the heated liquid in said liquid discharge passage from being cooled by the unheated pressurized air in said air discharge passage.

2. The liquid dispensing apparatus of claim 1, wherein said thermal insulation gap is an air space formed in the nozzle.

3. The liquid dispensing apparatus of claim 1, wherein said nozzle is formed in at least two pieces including a liquid dispensing nozzle portion having said liquid discharge passage and an air cap having said air discharge passage.

4. The liquid dispensing apparatus of claim 3, wherein said thermal insulation gap is disposed between said liquid dispensing nozzle portion and said air cap.

5. The liquid dispensing apparatus of claim 4, wherein said thermal insulation gap is an air space.

6. Apparatus for dispensing heated liquid onto a substrate, comprising:

a dispenser body having a liquid passageway adapted to connect to a source of heated liquid;

a liquid dispensing nozzle portion having a liquid discharge passage and being positioned on said dispenser body so that said liquid discharge passage communicates with said liquid passageway in said dispenser body;

an air cap for securing said liquid dispensing nozzle portion to said dispenser body, said air cap having an opening for exposing at least a portion of said nozzle portion and at least one air discharge passage adapted to connect to a source of unheated pressurized air, said air discharge passage being positioned relative to said liquid discharging passage to direct the pressurized air toward the heated liquid exiting said liquid discharge passage; and a thermal insulation gap containing a thermal insulation medium positioned between said air discharge passage and said liquid discharge passage and coextensive with at least said air discharge passage for substantially preventing the heated liquid in said liquid discharge passage from being cooled by the unheated pressurized air in said air discharge passage.

7. The liquid dispensing apparatus of claim 6, wherein said thermal insulation gap is an air space formed generally between said nozzle portion and said air cap.

8. The liquid dispensing apparatus of claim 6 further comprising a plurality of said air discharge passages.

9. Apparatus for dispensing heated liquid onto a substrate, comprising:

a dispenser body having a liquid passageway adapted to connect to a source of heated liquid;

a liquid dispensing nozzle portion connected with said dispenser body and including a liquid discharge passage communicating with the liquid passageway;

an air cap connected with the dispenser body and receiving said liquid dispensing nozzle portion, said air cap including at least one air discharge passage adapted to be connected with a source of unheated pressurized air and positioned relative to said liquid discharge passage to direct the pressurized air toward the heated liquid exiting said liquid discharge passage;

a thermal insulator insulation gap containing a thermal insulation medium positioned between said liquid discharge passage and said air discharge passage and coextensive with at least said air discharge passage for substantially preventing the heated liquid in said liquid discharge passage from being cooled by the unheated pressurized air in said air discharge passage.

10. The liquid dispensing apparatus of claim 9, wherein said liquid dispensing nozzle portion further includes an air inlet port adapted to connect to the source of pressurized air, said inlet port being in fluid communication with said air discharge passage.

11. The liquid dispensing apparatus of claim 9, wherein said air cap and said liquid dispensing nozzle portion include mating threaded portions for securing said air cap to said liquid dispensing nozzle portion.

12. The liquid dispensing apparatus of claim 11, wherein said liquid discharge passage extends along an axis and said air cap connects to said liquid dispensing nozzle portion by engaging said threaded portions about said axis.

13. The liquid dispensing apparatus of claim 9 further comprising a plurality of air discharge passages disposed about said liquid discharge passage.

14. The liquid dispensing apparatus of claim 9, wherein said thermal insulation gap further comprises an air space.

15. A method of dispensing a heated liquid from a dispenser having a liquid discharge passage, an air discharge passage, a thermal insulation gap containing a thermal insulation medium positioned between said air discharge passage and said liquid discharge passage and coextensive with at least said air discharge passage. the liquid discharge passage connected with a source of the heated liquid and the air discharge passage connected with a pressurized source of air, the method comprising:

discharging the heated liquid at a first temperature from the liquid discharge passage of the dispenser, discharging the air at a second temperature which is substantially lower than the first temperature through the air discharge passage and towards the heated liquid exiting the liquid discharge outlet, and thermally insulating the heated liquid from the air with the thermal insulation medium while the heated liquid and the air are in the liquid and air discharge passages to substantially prevent the heated liquid from being cooled by the air while the heated liquid is in the liquid discharge passage.

16. The method of claim 15, wherein said second temperature is substantially equal to ambient temperature.

17. The method of claim 16, wherein said second temperature is at least about 50% lower than said first temperature.

18. The method of claim 16, wherein the heated liquid is impacted with a plurality of air streams directed from a plurality of said air discharge passages.

19. The method of claim 18, wherein the air streams create a swirled pattern of the heated liquid.

20. The method of claim 16, wherein the heated liquid in said liquid discharge passage is cooled less than about ten percent by the air in said air discharge passage.

* * * * *

UNITED STATES PATENT AND TRADEMARK OFFICE

CERTIFICATE OF CORRECTION

PATENT NO. : 6,149,076
DATED : November 21, 2000
INVENTOR(S) : John M. Riney

It is certified that error appears in the above-identified patent and that said Letters Patent is hereby corrected as shown below:

Column 8,
Line 65, delete "insulator".

Column 9,
Line 28, change "." to -- , --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*